United States Patent [19]

DeLaney

[11] 4,275,609

[45] Jun. 30, 1981

[54] POSITIVE SAFETY BRAKE FOR OIL WELL PUMPING APPARATUS

[76] Inventor: Gene DeLaney, P.O. Box 283, San Ardo, Calif. 93450

[21] Appl. No.: 84,838

[22] Filed: Oct. 15, 1979

Related U.S. Application Data

[63] Continuation-in-part of Ser. No. 61,859, Jul. 30, 1979, abandoned.

[51] Int. Cl.[3] ..... F16H 21/32; F16H 57/10

[52] U.S. Cl. ..... 74/41; 74/411.5; 188/69

[58] Field of Search ..... 188/31, 60, 69; 74/41, 74/411.5

[56] References Cited

U.S. PATENT DOCUMENTS

| | | | |
|---|---|---|---|
| 1,346,949 | 7/1920 | Gibson et al. | 188/31 |
| 1,919,903 | 7/1933 | Parsons | 188/31 |
| 2,855,974 | 10/1958 | Heckethorn | 74/125.5 |
| 3,356,185 | 12/1967 | Isaacks | 188/69 |

FOREIGN PATENT DOCUMENTS

| | | | |
|---|---|---|---|
| 781957 | 3/1935 | France | 188/69 |
| 643618 | 9/1950 | United Kingdom | 74/41 |
| 823372 | 11/1959 | United Kingdom | 188/31 |

*Primary Examiner*—Lawrence J. Staab
*Attorney, Agent, or Firm*—Donald A. Streck

[57] ABSTRACT

A safety brake adapted for positively locking the crank and counter-balance weights of oil well pumping apparatus against rotation, particularly for placement and servicing of the pumping unit. In the preferred embodiment shown, a cylindrical member is bolted to a brake drum which rotates in combination with the shaft from the gear box carrying the crank and counter-balance weights. The cylindrical member has a plurality of holes disposed about its periphery. A movable engaging bar is rotatably carried on a shaft mounted to a bracket adapted for connection to the bearing cap on the gear box adjacent the brake drum. The bar contains a locking tongue for engaging the holes in the cylindrical member. The bar is rotatable from a position engaged with the cylindrical member and a position removed therefrom. A spring bias is provided to hold the bar in either of the two positions. Additionally, a jerk bar, having a hammer weight thereon and a handle portion, is provided for striking the lock bar to forceably disengage the locking tongue from a hole of the cylindrical member when under rotational force.

5 Claims, 11 Drawing Figures

POSITIVE SAFETY BRAKE FOR OIL WELL PUMPING APPARATUS

This is a continuation in part of application Ser. No. 061,859, filed July 30, 1979.

BACKGROUND OF THE INVENTION:

The present invention relats to oil well pumping apparatus and, in particular, to brakes used to prevent rotation of the crank and counter-balance weights.

An oil pumping environment as wherein the present invention is particularly applicable is shown in FIG. 1. In such apparatus, a derrick 10 is erected adjacent an oil well head 12. A wire cable 14 extends from a hoist drum (not shown) over a crown block 16 to a travelling block 18, which in turn is connected to well tubing 20. A derrick man operating platform 22 is suspended from the derrick 10 by a guy line 24 to be disposed about the wire cable 14 rising upward from the oil well head 12. Personnel stand on the platform 22 to perform necessary functions as the well tubing 20 is raised or lowered by the wire cable 14 by means of the hoist drum (not shown).

When the oil well has been drilled, a pumping unit, generally indicated as 26, is positioned to move a pump rod extending through oil well head 12 up and down to, thereby, pump the oil from the well. Such pumping units 26 are generally configured generally as shown, comprising a pumping unit base 28 upon which is mounted a unit drive motor 30 connected to a gear box 32. The gear box 32 has a first shaft 34 projecting therefrom which is rotated by the unit drive motor 30. A crank 36 is mounted on the first shaft 34 for rotation thereby. A set of counterbalance weights 38 are attached to the crank 36 adjacent the end thereof furthest from first shaft 34. A walking beam 40 is mounted atop a set of Sampson posts adjacent the gear box 32. The end of the walking beam 40 closest to the gear box 32 is connected to the crank 36 by a Pitman arm 44. Thus, as first shaft 34 rotates, crank 36 is rotated in combination therewith. As crank 36 rotates, the walking beam 40 is reciprocally pivoted about the center on the Sampson posts. By positioning the opposite end of the walking beam 40 above the well head 12, that end of the walking beam 40 can be connected to a pump rod, which will then be reciprocally driven into and out of the oil well head 12 as the crank 36 rotates to, thereby, pump the oil.

Both at the time of installation and during later servicing of the pumping oil well, one or more operating personnel are required to stand on the platform 22 for such jobs as pulling tubing, pump rods, the pump, etc. for observance, or replacment if necessary.

As can be seen from FIG. 1, as the crank 36 rotates from the upper position labeled "A" to the ghosted lower position labeled "B", the end of the walking beam 40 closest to the oil well head 12 moves between an extremely lowered position labeled "A" and an extreme raised position shown ghosted and labeled "B". Because of equipment size limitations, the platform 22 must be positioned as shown, such that at some point in the travel of the end of walking beam 40 between the lowered position A' and the raised position B' the end of walking beam 40 is at or above the level of the platform 22. Thus, crank 36 must be maintained in a generally raised position adjacent postion A while the platform 22 is positioned above the oil well head 12. For this purpose, a second shaft 46 operably connected with gear box 32 extends therefrom. A friction brake assembly, generally indicated as 48, is connected to second shaft 46. By engaging friction brake assembly 48, the rotation of crank 36 can be frictionally impeded or stopped.

Friction brake assembly 48 is shown in greater detail in FIG. 2. Second shaft 46 has a cylindrical brake drum 50 concentrically attached thereto as with bolts 52. Brake shoes 54 are disposed within brake drum 50. Brake shoes 54 can be moved radially outward into frictional engagement with brake drum 50 to, thereby, tend to prevent the rotation of brake drum 50 and, thereby, second shaft 46 and, in association therewith, first shaft 34. As can be seen, such a system is not a positive locking device and, therefore, presents a safety hazard to the operating personnel. Slippage or inadvertent release of the brake shoes 54 from the frictional engagement with brake drum 50 will allow crank 36 to move from position A to position B and, correspondingly, walking beam 40 to move from position A' towards position B' and, thereby, strike platform 22.

Yet another form of prior art braking mechanism employing an unsuccessful positive lock is shown with reference to FIGS. 9–11. In this type of brake, shaft 46 has a large metallic drum 110 attached thereto. A braking band 112 is disposed about the periphery of the drum 110 being held on one side by a bracket 114 mounted to a pivot pin 116. The two ends of braking band 112 meet on the opposite side in spaced relationship with one side connected to a flexible sleeve 118 and the opposite side connected to a flexible cable 120 slidably disposed within the flexible sleeve 118. By pulling the flexible cable 120 into the flexible sleeve 118, the braking band 112 can be compressed about the metallic drum 110 to cause a sliding braking action similar to the brake shoes 54 acting on the inside of the cylindrical brake drum 50 in the embodiment of FIG. 2 described above.

In addition, however, the braking band 112 covers only a portion of the width of the periphery of the metallic drum 110. Adjacent the rear surface thereof, a series of shallow recesses 122 are formed therein. A heavy iron locking bar 124 is pivotally mounted on one end to a pivot pin 126 mounted parallel to shaft 46. Locking bar 124 contains a projection 128 on the end opposite pivot pin 126. Projection 128 is adapted to fit into the shallow recesses 122 when locking bar 124 is rotated from the position shown in FIG. 9 to the ghosted position shown in FIG. 9.

While it was probably intended that braking units for well pumps configured as shown in FIGS. 9–11 would provide an additional margin of safety not contained in units configured with only a sliding brake, such is not the case. In actuality, the providing of the "locking" bar 124 which is not sufficient for its intended purpose may, in fact, create a bigger hazard than having it omitted. This is clear from the typical warning tag which is attached to the locking bar 124 as indicated by arrow 130 in FIG. 9, or attached adjacent thereto. The text of an actual tag as copied by applicant from such apparatus read as follows: "BE CAREFUL—the pumping unit brake is not intended as a safety stop, but is intended for operational stops only—apply brakes slowly. Sudden stops may damage equipment. When operations or maintenance are to be conducted in or around the pumping unit, the position of the crank arms and counterweights should be fixed securely in a stationary position by chaining or other acceptable means-".

Clearly, therefore the locking bar 24 and its relationship with shallow recesses 122 does not provide a satisfactory safety brake for such apparatus. A satisfactory safety brake meeting OSHA requirements for a safety brake does not exist in the art at present. As can be understood, locking bar 124 can be manipulated only by personnel moving in close proximity to the large rotating members of the pumping apparatus. There is no bias on locking bar 124 tending to hold it either into engagment with the shallow recesses 122 or in a safely removed position therefrom when the machine is normally operating. It is typical that because of the vibrations attendant to the operation of such machinery locking bar 124 falls onto metallic drum 110 as the apparatus is rotating causing the edges of the shallow recesses 122 and the projection 128 of locking bar 124 to become rounded as shown as shown by the arrows 132 in FIG. 11. As thus configured, any rotary pressure against the projection 128 by the turning of drum 110 in the direction of arrow 134 creates a vertical force, as symbolized by the arrow 136, tending to pull the projection 128 out of the shallow recess 122 into which it has been inserted.

Wherefore, it is the primary objective of the present invention to provide a positive lock to prevent the rotation of crank 36 during periods of installation and servicing.

It is a further objective of the present invention to provide a positive lock for such oil pumping apparatus which is easily adaptable for attachment to existing apparatus.

It is yet another object of the present invention to provide a positive lock for oil well pumping apparatus which is readily and safely releasable under extreme holding forces imparted by the large counterbalance weights employed in such apparatus.

SUMMARY

The foregoing objectives have been met in oil well pumping apparatus wherein a motor drives a gear box having a rotating shaft with a crank and counter-balance weights moving in combination therewith and wherein the crank is connected through a Pitman arm to a walking beam, by the improvement for locking the crank against inadvertent rotation as a safety measure during servicing and positioning of the apparatus comprising first locking means carried by the shaft for rotation therewith, the first locking means including a member having at least one hole therethrough; and, second locking means carried by the gear box and movable between a first position non-slidably engaged with the first locking means to prevent rotation of the shaft (and, thereby, the crank) and a second position disengaged from the first locking means so that the shaft (and crank) is free to rotate, the second locking means including an engaging member adapted to pass through the hole to cause the non-sliding engagement.

In the preferred embodiment shown, the shaft includes a cylindrical brake drum rotating therewith having a brake shoe disposed for slidable engagement therewith to impede rotation of the shaft; the first locking means comprises a rotating member concentrically disposed with the axis of the cylindrical brake drum and having the at least one hole therein radially disposed from the axis.

Additionally, spring bias means are connected to the second locking means for biasing the second locking means to the one of the first and second positions into which it is placed.

Also, the preferred embodiment includes a disengaging member disposed for engagement with the second locking means, the disengaging member including a handle for manually moving the disengaging member and a weighted member adapted to be moved by the handle to strike the second locking member to impart a force thereto tending to remove the engaging member from the hole.

DESCRIPTION OF THE PREFERRED EMBODIMENT

Figure 2:
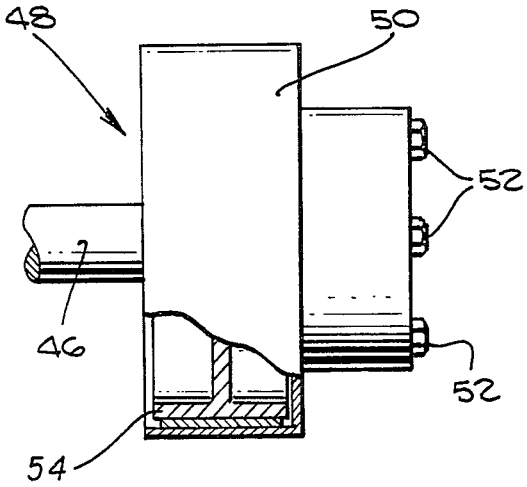
Fig. 2. PRIOR ART
FIG. 2 is a partially cut-away view through a prior art friction drum brake as employed in the apparatus of FIG. 1.
Figure 1:
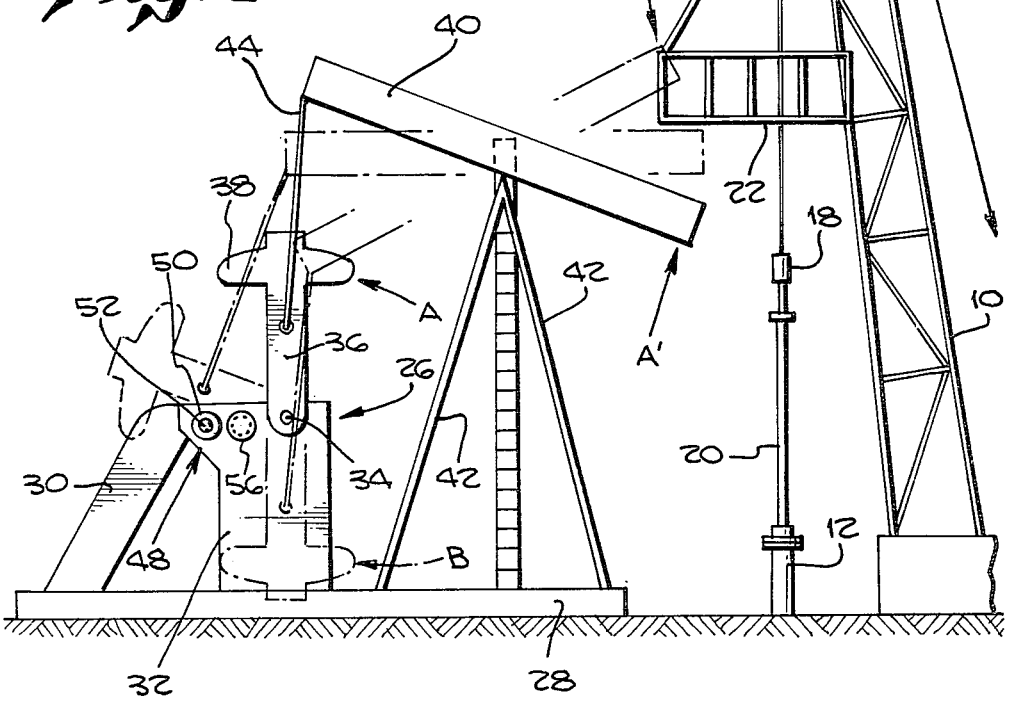
FIG. 1 is a simplified elevation view of oil well drilling and pumping apparatus as wherein the present invention is employed.
Figure 4:
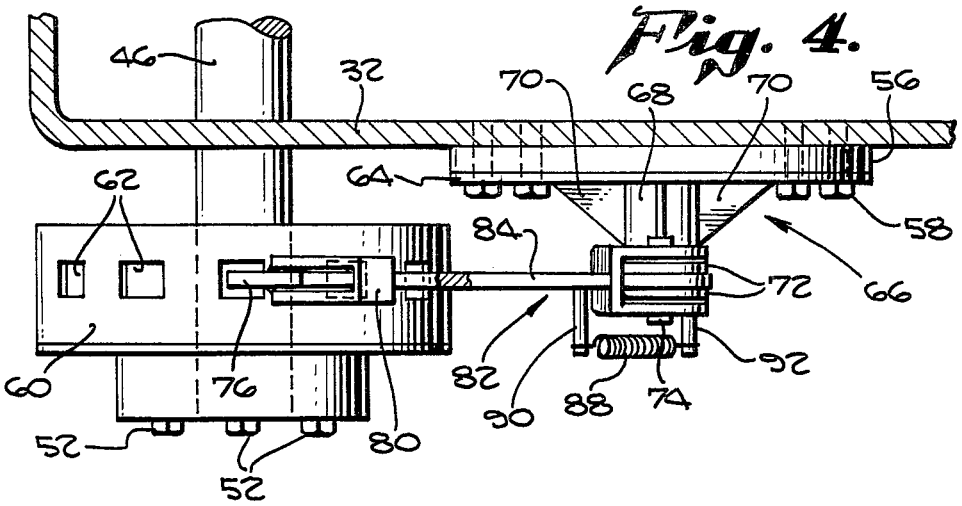
FIG. 4 is a top view of the apparatus of FIG. 3.
Figure 3:
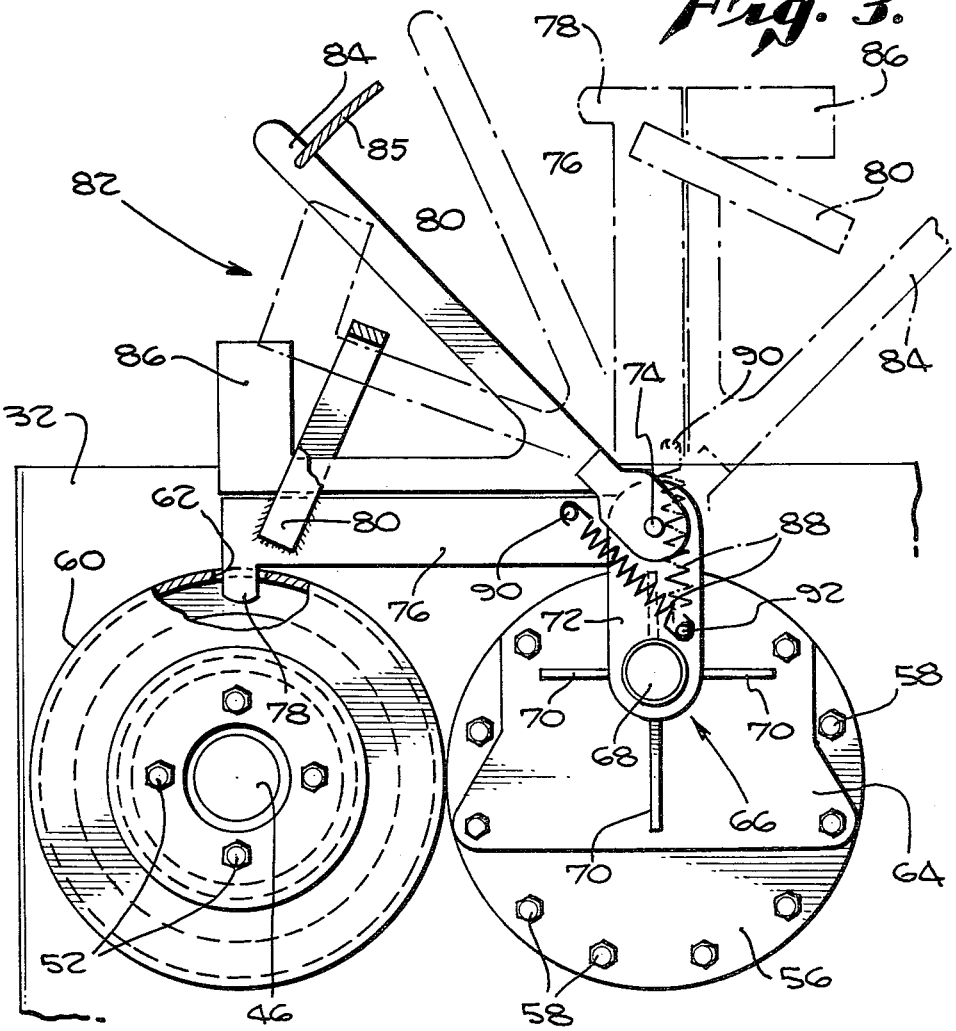
FIG. 3 is an elevation view of the apparatus of the present invention according to its preferred embodiment.
Figure 6:
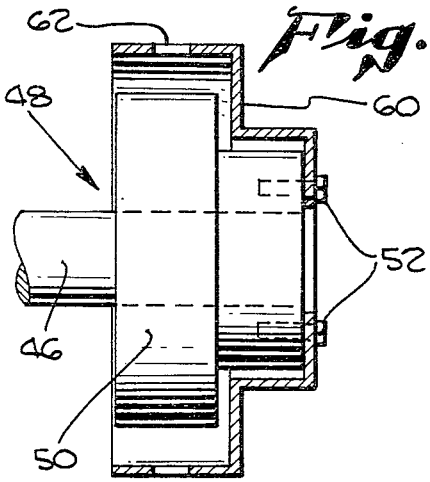
FIG. 6 is a partially cut-away view through the drum locking portion of the present invention as shown in FIGS. 3–5.
Figure 7:
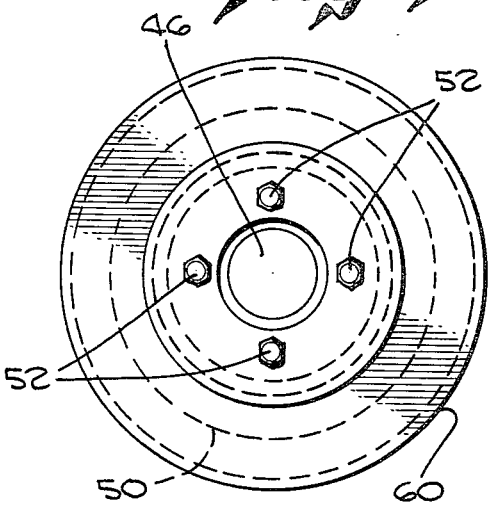
FIG. 7 is a front view of the drum of FIG. 6.
Figure 5:
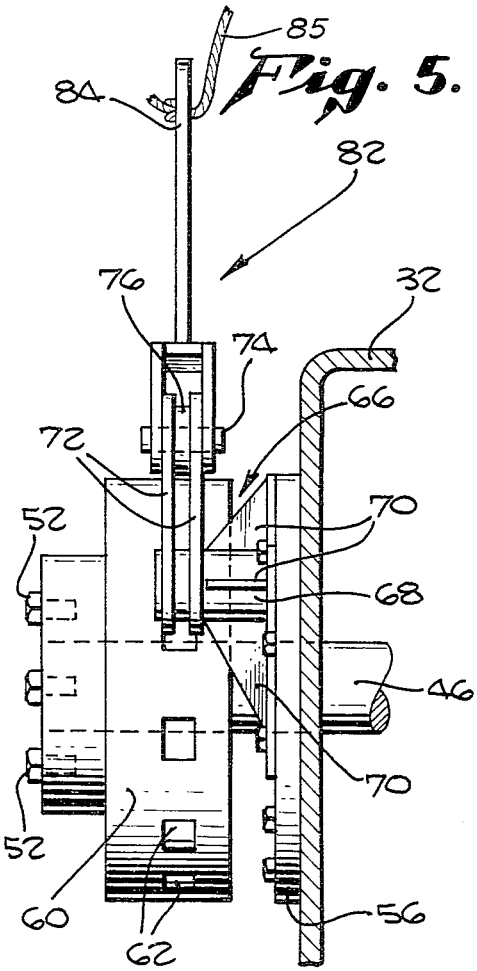
FIG. 5 is a side view of the apparatus of FIGS. 3 and 4.

Referring briefly once again to FIGS. 1 and 2, it will be remembered that first shaft 34 and second shaft 46 of the gear box 32 move in combination and that friction brake assembly 48 is typically provided to attempt to hold the crank 36 in a given position. Conveniently, a bearing cap 56 is typically located adjacent the friction brake assembly 48 being attached to the gear box 32 with bolts 58.

Referring now to FIGS. 3 thru 7, in the preferred embodiment of the present invention, the first portion comprises a cylindrical locking drum 60 disposed about the outer periphery of cylindrical brake drum 50 and attached to move in combination therewith by the bolts 52. Cylindrical locking drum 60 has a plurality of rectangular holes 62 disposed about its periphery as shown. Such an arrangement allows positioning the crank 36 at more than one position. One hole would, of course, suffice if the crank were to be locked in only one position.

Figure 9:
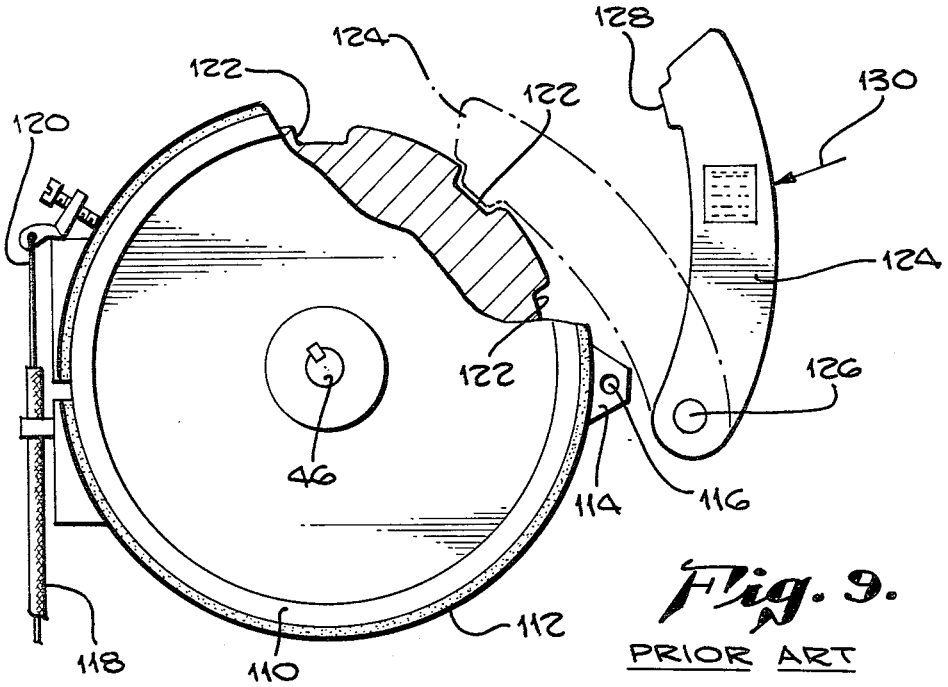
Fig. 9. PRIOR ART
FIG. 9 is a partially cut-away elevation view through a prior art friction brake drum according to a second embodiment as employed in the apparatus of FIG. 1 and wherein an ineffective locking bar is employed.
Figure 10:
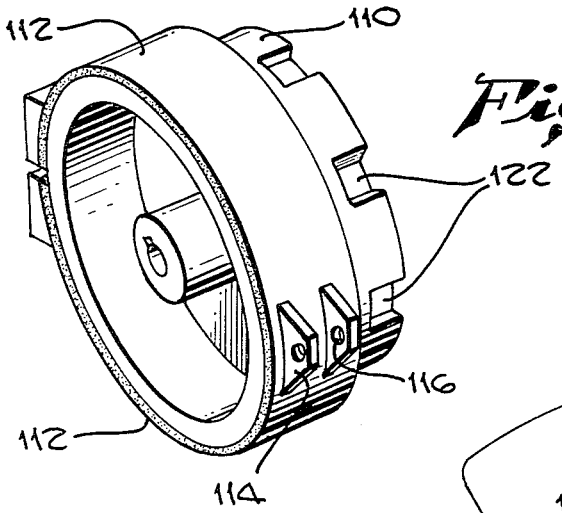
Fig. 10. PRIOR ART
FIG. 10 is an perspective view of the apparatus of FIG. 9 showing the shallow recesses intended for locking the drum from rotation.
Figure 11:
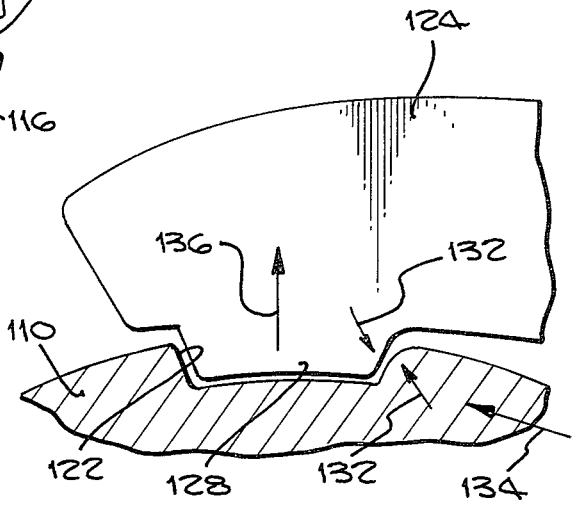
Fig. 11. PRIOR ART
FIG. 11 is a detailed view of the engagement of the projection on the locking bar of the apparatus of FIG. 9 with the shallow projections contained in the rotating drum.

The second portion of the present invention comprises a bracket plate 64 adapted to be mounted close adjacent the bearing cap 56 by at least a portion of the bolts 58 thereof. A support arm assembly, generally indicated as 66, extends from the bracket plate 64. The support arm assembly 66 is rigidly supported to with-stand the potentially extreme forces which could be imparted thereto by the weights 38 acting through crank 36. In a tested embodiment as shown in the drawings, support arm assembly 66 comprises a horizontal shaft 68 welded to bracket plate 64 having triangular support members 70 welded between the shaft 68 and bracket 64 for added support and bracing. A pair of vertical support arms 72 are welded to the horizontal shaft 68 on one end and extend in parallel-spaced relationship on either side of a plane passing through the rectangular holes 62 for alignment. A horizontal pivot pin 74 is provided on the upper end of vertical support arm 72. A lock bar 76 is pivotally mounted to pivot pin 74 on one end and extends in the aforementioned plane to a position above the cylindrical locking drum 60 on the opposite end. A locking tongue 78 is provided on the end of lock bar 76 adjacent locking drum 60. Locking tongue 78 is adapted to be inserted into and through the rectangular holes 62 as they achieve a position of alignment therewith and, thereby, securely engage and hold the cylindrical locking drum 60. Note that as opposed to the shallow depressions 122 and short projection 128 of the apparatus of FIGS. 9–11, the tongue 78 and edges of the holes 62 of the present invention could be rounded as will occur in normal operation without causing the apparatus to lose its positive locking qualities. With the locking tongue 78 of lock bar 76 thus engaged with one of the rectangular holes 62 of cylindrical locking drum 60, it can be seen that cylindrical locking drum 60, cylindrical brake drum 50, second shaft 46, and, thereby, first shaft 34 having crank 36 thereon are all securely locked from rotational movement.

While the positive locking features of the above-described apparatus are desirable, counter-balance weights 38 can create a tremendous rotational force on cylindrical locking drum 60. Such force will tend to prevent the easy removal of locking tongue 78 from the rectangular hole 62 into which it has been inserted. While this is desirable from a rotational safety point of view, it can create a potentially unsafe condition at the time that it is desired to unlock the assembly by removing the locking tongue 78 from the rectangular holes 62 to allow free movment of cylindrical locking drum 60.

To prevent potential injury lock bar 78 is provided with a generally U-shaped lifting loop 80, as by welding thereto. A jerking assembly, generally indicated as 82, is also pivotally mounted for rotation about pivot pin 74. Jerking assembly 82 is generally V-shaped with the pivot point being at the point of the V as shown. One arm of the V (the uppermost portion) comprises a jerk handle 84 adapted to be manually gripped and moved. The other end of the V is provided with a hammer weight 86. By gripping the jerk handle, the jerking assembly 82 can be rotated to cause the hammer weight portion 86 thereof to strike the top of the lifting loop 80 to thereby impart a force to the lock bar 76 tending to withdraw the locking tongue 78 from the rectangular hole 62 even under extreme rotational force. By continuing to rotate the jerk handle 84, the entire jerking assembly and lock bar 76 can be withdrawn to the extreme vertical position shown in ghosted form to be completely removed from potential engagement with the cylindrical locking drum 60. Moreover, for added safety, a rod, or rope 85 can be fastened to the jerk handle 84, as shown, whereby lockbar 76 can be disengaged from a remote position of safety.

For added safety, a spring 88 is mounted between a first post 90 carried by lock bar 76 and a second post 92 carried by support arm assembly 66. As can be seen, the posts 90, 92 are disposed out of linear alignment with the pivot pin 74 such that spring 88 creates a bias force tending to hold the locking tongue 78 into engagement with cylindrical locking drum 60 when lock bar 76 is in the locked position, shown and tending to maintain lock bar 76 in the raised and removed ghosted position when moved to that position.

Figure 8:
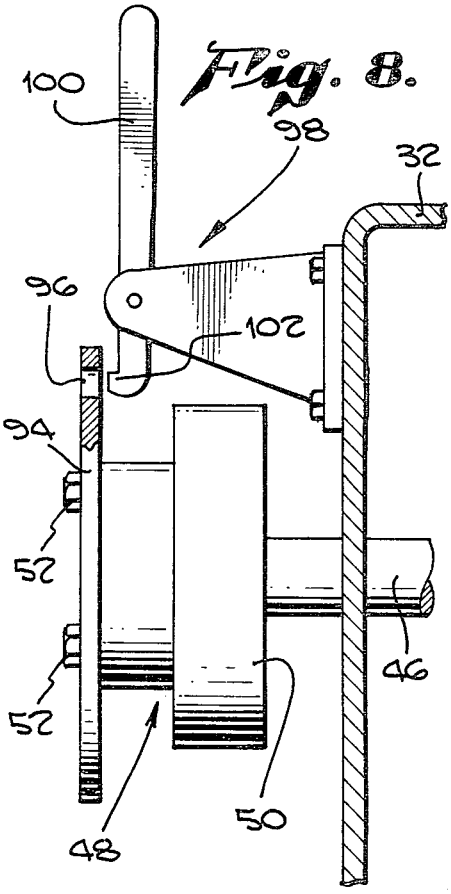
FIG. 8 is a side partially cut-away view through apparatus of the present invention according to an alternate embodiment thereof.

While the preferred embodiment of the present invention has been described with particularlity above, it will be understood by those skilled in the art that modifications thereof are possible within the scope and spirit of the invention. For example, referring to FIG. 8, cylindrical locking drum 50 could be provided with a circular locking plate 94 mounted concentrically with the end of cylindrical brake drum 50 and attached thereto with bolts 52. A plurality of holes 96 could be provided therein radially displaced from the axis of the shaft 46. A revised support arm assembly 98 would then be provided to support a locking bar 100 having a locking tongue 102 adapted for pivotal engagement and disengagment with the holes 96.

Wherefore, having thus described my invention, I claim:

1. In oil well pumping apparatus wherein a motor drives a gear box having a rotating shaft and a crank, the shaft including a cylindrical brake drum rotating therewith having a brake shoe disposed for slidable engagement therewith to impede rotation of the shaft, the gear box also having counter-balance weights moving combination therewith and wherein the crank is connected through a Pitman arm to a walking beam, the improvement for locking the crank during inadvertent rotation as a safety measure during servicing and positioning of the apparatus comprising:

(a) first locking means carried by the shaft for rotation therewith, said first locking means comprising a rotating member carried by the brake drum concentrically disposed with the axis of the cylindrical brake drum and having at least one hole therein radially disposed from said axis;

(b) second locking means carried by the gear box and movable between a first position non-slidably engaged with said first locking means to prevent rotation of the shaft and a second position disengaged from said first locking means so that the shaft is free to rotate, said second locking means including an engaging member adapted to pass through said hole to cause said non-sliding engagement; and (c) a disengaging member disposed for engagement with said second locking means, said disengaging member including a handle for manually moving said disengaging member and a weighted member adapted to be moved by said handle to strike said second locking member to impart a force thereto tending to remove said engaging member from said hole.

2. The safety improvement to oil well pumping apparatus of claim 1 and additionally comprising:

spring bias means connected to said second locking means for biasing said second locking means to the one of said first and second positions into which it is placed.

3. In a gearbox for oil well pumping apparatus having a first rotating shaft, carrying the crank and the counterbalance weights, a second shaft rotating in combination with the first shaft carrying a friction brake drum for engagement by a brake shoe to impede the rotation of the first and second shafts, and a bearing cover attached adjacent the brake drum by a plurality of bolts, the positive safety brake comprising:

(a) a cylindrical member attached to the brake drum in concentric alignment for rotation therewith, said member having a plurality of holes radially spaced from the axis of rotation (b) a support arm assembly adapted for attachment to the gear box, said support arm assembly having a pivot pin disposed in horizontal alignment with the axis of rotation of said cylindrical rotating member;

(c) a locking bar pivotally attached to said pivot pin in one end and having a locking tongue projecting outward substantially normal to said locking bar on the other end, said locking bar being pivotal between a first position with said locking tongue inserted into one of said holes of said cylindrical rotating member to prevent said rotating member from rotating and a second position with said locking tongue disengaged from all of said holes to allow said rotating member to rotate; and, (d) rotating jerk means pivotally attached to said pivot pin for manual rotation when said locking bar is in said first position to strike said locking bar with sufficient force to withdraw said locking tongue from any one of said holes into which it is inserted and to thereafter rotate said locking bar to said second position.

4. The positive safety brake for the gearbox of oil well pumping apparatus of claim 3 and additionally comprising:

spring bias means operably connected to said locking bar for biasing said bar to remain in the one of said two positions into which it is placed.

5. The positive safety brake for the gearbox of oil well pumping apparatus of claim 3 wherein;

said rotating jerk means includes a member extending from adjacent said locking bar to a location of safety removed from adjacent said locking bar for actuating said jerk means to move said locking bar to said second position.

* * * * *